United States Patent [19]

Koch et al.

[11] 4,074,013

[45] Feb. 14, 1978

[54] CORRODIBLE IRON-CONTAINING SURFACES CARRYING CORROSION-INHIBITING COATING

[75] Inventors: Karlheinz Koch, Haan; Gerhard Kolaczinski, Dusseldorf-Oberkassel; Wolfgang Rupilius, Dusseldorf; Werner Stein, Erkrath-Unterbach, all of Germany

[73] Assignees: Henkel KGaA, Dusselfdorf; Deutsche Gold- und Silber-Scheideanstalt vormals Roessler, Frankfurt, both of Germany

[21] Appl. No.: 683,516

[22] Filed: May 5, 1976

[30] Foreign Application Priority Data

May 7, 1975 Germany ..... 2520275

[51] Int. Cl.[2] ..... C23F 11/00; C09D 5/08; B32B 15/04

[52] U.S. Cl. ..... 428/457; 21/2.7 R; 106/14; 252/392; 260/584 R; 427/337; 427/388 R; 428/538

[58] Field of Search ..... 428/457, 538; 252/392; 21/2.7 R; 106/14; 260/584 R, 534 M; 72/42; 427/388 R, 337

[56] References Cited

U.S. PATENT DOCUMENTS

| | | | |
|---|---|---|---|
| 2,587,546 | 2/1952 | Matuszak | 252/392 |
| 2,856,363 | 10/1958 | Brennan | 252/392 |
| 2,914,475 | 11/1959 | Oxford | 252/392 |
| 2,918,390 | 12/1959 | Brown | 428/457 |
| 3,033,796 | 5/1962 | Findley | 252/392 |
| 3,723,530 | 3/1973 | Goetze | 260/584 R |
| 3,766,184 | 10/1973 | Johansson | 260/584 R |
| 3,872,116 | 3/1975 | Gipson | 260/584 R |
| 3,897,349 | 7/1975 | Marin | 252/392 |
| 3,953,512 | 4/1976 | Belzecki | 260/584 R |
| 3,974,323 | 8/1976 | Brouillette | 428/457 |

*Primary Examiner*—Ellis Robinson
*Attorney, Agent, or Firm*—Hammond & Littell

[57] ABSTRACT

Corrodible iron-containing metals (including steel) possess decreased tendency to corrode when contacted with aqueous media (including dilute strong mineral acids) when they carry a surface coating of mixtures of aminoalkanols of the formula:

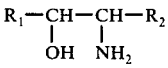

wherein $R_1$ and $R_2$ each represent a $C_{1-21}$ alkyl; and wherein the sum of the carbon atoms in $R_1$ and $R_2$ is 6 to 22. The vicinal substituents are non-terminal and are preferably uniformly distributed along the chain. The aminoalkanols are useful both in free base and in salt form.

9 Claims, No Drawings

CORRODIBLE IRON-CONTAINING SURFACES CARRYING CORROSION-INHIBITING COATING

FIELD OF THE INVENTION

The present invention relates to normally corrodible iron-containing surfaces of decreased tendency to corrode when contacted with aqueous media (including aqueous acids). The invention includes such surfaces carrying a coating of anti-corrosion agent, and methods for providing such surfaces.

BACKGROUND OF THE INVENTION

Application Ser. No. 521,245 filed Nov. 6, 1974, by Karl-Heinz Koch discloses aminoalkanol mixtures of the formula:

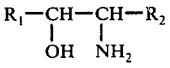

wherein $R_1$ and $R_2$ each represent H and $C_1$-$C_{20}$ alkyl with the provisos that the sum of the carbon atoms in both $R_1$ and $R_2$ is 6 to 20, that only one of $R_1$ and $R_2$ can be H, and that the vicinal OH and $NH_2$ substituents are distributed randomly (i.e., uniformly) over the chains.

The corrosion of iron-containing metals (particularly steel) by aqueous fluids is a major source of loss to industry. It has long been known that such corrosion can be inhibited by a variety of means, perhaps the simplest of which is the application to the metal of a hydrophobic material. Modern safety and ecological requirements make it very desirable that the hydrophobic material be substantially odorless and substantially harmless to the eyes and skin of humans. The amines of naturally occurring fat materials have been used for the purpose, but usually have a strong and unpleasant odor and are very irritating (and sometimes dangerously harmful) to the skin and eyes.

OBJECTS OF THE INVENTION

It is a principal object of the invention to provide shaped articles having surfaces of a corrodible iron-containing metal which possess decreased tendency to corrode when contacted with aqueous fluids and vapors, including acidic fluids and vapors.

It is a further object of the invention to provide such surfaces by use of an anti-corrosion agent which can be made easily and cheaply from readily available raw materials, which is comparatively safe to apply from the dermatological point of view, which has an inoffensive odor, and which can be applied to metal in rapid and simple manner.

THE INVENTION

The foregoing and other objects are attained by the present invention. We have found that corrodible iron-containing metals (including steel) possess decreased tendency to corrode when contacted with aqueous media (including dilute strong mineral acids), when they carry a coating of a material selected from the group consisting of (A) mixtures of at least two aminoalkanols of the formula:

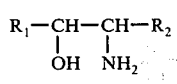

wherein $R_1$ and $R_2$ each represent $C_{1-21}$ alkyl; and wherein the sum of the carbon atoms in $R_1$ and $R_2$ is between 6 and 22; and the vicinal substituents are uniformly distributed along the

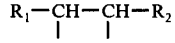

chain; and (B) salts thereof.

The surfaces are protected against corrosion when a comparatively thin layer of the aminoalkanol mixture is present (i.e., when the surface has been wet with a 1% solution of the aminoalkanol and the solvent phase has been allowed to evaporate), and when the resulting surface has been washed with a stream of water. In the latter event only a substantially monomolecular film (i.e., a film 1-10 molecules thick) remains, but this is a sufficient amount to provide excellent protection.

We have further found that these aminoalkanol mixtures greatly decrease the tendency of said surfaces to corrode when contacted with said fluids and vapors even when said aminoalkanol mixtures are present on said surfaces as substantially monomolecular layers.

We have still further found that such corrodible surfaces can be protected by subjecting the surfaces to be protected to a brief contact with an aqueous or organic solution of one of the above-described aminoalkanol mixtures in free base or salt form.

In the preparation of aminoalkanol mixtures suitable for use in the present invention, suitable starting materials are the various mixtures of monoolefins containing 8 to 24 carbon atoms and statistically distributed, non-terminal double bonds, i.e., double bonds which are distributed along the carbon chain in accordance with known frequency of distribution curves. Such mixtures of olefins are known. They can be obtained, for example, by catalytic dehydrogenation or chlorination followed by dehydrochlorination of $C_8$-$C_{24}$ paraffins and selective extraction of the non-terminally unsaturated monoolefins. It is possible to use olefin mixtures which contain saturated hydrocarbons used in the preparation of these olefins. These saturated hydrocarbons are inert in the processing steps which follow and so act primarily as diluents.

The fractions of non-terminally unsaturated monoolefins with a high content of linear $C_{11}$-$C_{14}$ or $C_{15}$-$C_{18}$ olefins, particularly those with the chain length distribution indicated below, are preferably employed.

| | | |
|---|---|---|
| (a) | Fraction $C_{11}-C_{14}$ | |
| | Olefin | Approx. % by Wt. |
| | $C_{11}$ | 22 |
| | $C_{12}$ | 30 |
| | $C_{13}$ | 26 |
| | $C_{14}$ | 22 |
| (b) | Fraction $C_{15}-C_{18}$ | |
| | Olefin | Approx. % by Wt. |
| | $C_{15}$ | 26 |
| | $C_{16}$ | 35 |
| | $C_{17}$ | 31 |
| | $C_{18}$ | 6 |

For the preparation of the anti-corrosion agents useful in the invention, the olefin mixtures are first epoxidized by known methods, e.g., with peracetic acid, and the epoxide mixtures obtained (epoxy alkanes) are reacted with ammonia in the presence of water at elevated temperature and at elevated pressure, preferably in an autoclave under autogenous pressure.

The ammonia is used in a 5- to 20-fold, preferably 10- to 15-fold molar excess, based on the epoxide mixture used, while water is added in 1- to 20-fold, preferably 5- to 15-fold molar excess, again based on the epoxide mixture used.

The reaction is carried out in a stirring autoclave at a temperature of 160° to 220° C., preferably 190° to 210° C. at a pressure of about 40 to 150 atmospheres.

The time required for the reaction is 0.25 to 10 hours. The reaction is often completed in 0.5 to 1 hour.

The reaction product separates into phases, namely, the aminoalkanol phase and the ammonia-water phase. The aminoalkanol phase is removed and is purified by known methods, e.g., by distillation.

The salts of the aminoalkanol mixtures with aliphatic carboxylic acids with 2 to 24 carbon atoms such as acetic acid, caproic acid, lauric acid, palmitic acid, behenic acid, myristoleinic acid, oleic acid, linolic acid and lactic acid, can be prepared by known methods.

The aminoalkanol mixtures are suitable as corrosion inhibitors according to the invention. They can be added directly to gasoline, kerosene, and other hydrocarbon fuels, to oils and to lubricants, and they then inhibit the corrosion of corrodible iron-containing vessels in which these materials are stored. They can also be added to organic solvents for this purpose. Amounts in the range of 0.1% to 10% by weight are sufficient to provide a significant anti-corrosion action. Compared to the amines prepared from naturally occurring fatty products, which are generally used as corrosion inhibitors, the aminoalkanols described above show a much better protective effect and can be dosed more easily because of their low solidification points.

Another advantage of the aminoalkanol mixtures described above is that they are more pleasant and safe to employ because of their mild odor and their superior dermatological properties.

The preparation of preferred aminoalkanol mixtures is given in the copending, commonly-assigned U.S. Pat. Application Ser. No. 683,319, filed concurrently herewith (Attorney's Docket No. A-4804/5073-1) and is described more fully below.

A. Preparation of Aminoalkanol Mixtures

The designations $C_{11}$-$C_{14}$ and $C_{15}$-$C_{18}$ epoxides used in the examples mean mixtures of olefins which have statistically (i.e., uniformly) distributed, non-terminal double bonds having the chain length distributions indicated in the description. Such epoxidized olefins are epoxy alkanes.

EXAMPLE A 198 g. (approx. 1 mol) of a mixture of $C_{11}$-$C_{14}$ epoxy alkanes, 170 g. (10 mols) of ammonia, and 180 g. (10 mols) of water were stirred in a 3-liter, steel autoclave having a stroke-type stirrer for half an hour at 200° C. During the reaction, a maximum pressure of 80 atmospheres was autogenously developed. At the end of the reaction, the mixture was allowed to cool to room temperature and the aminoalkanol mixture was separated from the ammonia-water phase. The separated product was purified by distillation. A yield of 189 g. of the mono (hydroxy alkyl) amine was obtained, corresponding to 91% of theory. Boiling range: 93°–96° C. at 0.1 Torr.; solidification point: −5° C.; index of refraction at 20° C.: 1.4586; amine number, found: 268; calculated: 271. The di-(hydroxyalkyl)-amine was formed in an amount of 8% of theory.

EXAMPLE B

A mixture of 255 g. (approx. 1 mol) of a mixture of $C_{15}$-$C_{18}$ epoxy alkanes, 255 g. (15 mols) of ammonia, and 270 g. (15 mols) of water was stirred for 1 hour at a reaction temperature of 200° C. in a 3-liter steel autoclave having a stroke stirrer. The maximum autogenous pressure was 80 atmospheres. After cooling to room temperature, the product phase was separated and purified. We obtained a yield of 223 g. of the monoalkylation product, corresponding to 86% of theory. Boiling range: 116°–121° C. at 0.1 Torr.; solidification point: 16° C.; index of refraction at 20° C.: 1.4610; amine number, found: 204; calculated: 216. The di-(hydroxyalkyl)-amine as formed in an amount of 12% of theory.

EXAMPLE C 510 g. (approx. 2 mols) of an $C_{15}$-$C_{18}$ epoxy alkane mixture and 340 g. (20 mols) of ammonia were reacted in separate tests with 0, 2, 4, 6, 8, 10, 12, 12 and 16 mols of water respectively. The reactions were carried out in a 3-liter autoclave containing a propeller stirrer at 200° C. over 5 hours. The results are shown in Table 1.

Table 1

| Mols Water | Aminoalkanol Yield (% of Theory) Mono | Di. | Max. React. Pressure (Atmos.) |
|---|---|---|---|
| 0 | 14 | 5 | 159 |
| 2 | 70 | 14 | 150 |
| 4 | 82 | 11 | 134 |
| 6 | 85 | 10 | 125 |
| 8 | 86 | 9 | 112 |
| 10 | 87 | 8 | 101 |
| 12 | 89 | 7 | 97 |
| 14 | 88 | 7 | 93 |
| 16 | 90 | 5 | 90 |

EXAMPLE D

Another series of reactions was carried out with 510 g. (approximately 2 mols) of a mixture of epoxidized $C_{15}$-$C_{18}$ monoolefins, 180 g. (10 mols) of water and 5, 10, 15 and 20 mols of ammonia in a 3-liter autoclave provided with stroke stirrer at 200° C. over 5 hours. The results are compiled in Table 2.

Table 2

| Mols $NH_3$ | Aminoalkanol (Yield % of Theory) Mono | Di. | Max. React. Pressure atmos. |
|---|---|---|---|
| 5 | 34 | 52 | 38 |
| 10 | 75 | 23 | 56 |
| 15 | 86 | 12 | 77 |
| 20 | 87 | 8 | 101 |

B. APPLICATION

One method of inhibiting the corrosion of iron-containing surfaces is illustrated as follows. The following aminoalkanol mixtures were employed either in free base or in the form of salts with the acids shown.

| Exp. | Chain Length* | Acid Added** |
|---|---|---|
| A | $C_{11}$–$C_{14}$ | None |
| B | $C_{15}$–$C_{18}$ | None |
| C | $C_{11}$–$C_{14}$ | Oleic |
| D | $C_{15}$–$C_{18}$ | Oleic |
| E | $C_{11}$–$C_{14}$ | Lactic |

-continued

| Exp. | Chain Length* | Acid Added** |
|---|---|---|
| F | $C_{15}$–$C_{18}$ | Lactic |

*Of parent olefin
**To form the salt

The following products were included in the tests for comparison:

G: Dodecylamine
H: Distilled tallow amine
I: Distilled coconut amine
J: Dodecyl aminopropyl amine

EXAMPLE 1

The substances were tested according to the static water drop test (see H. R. Baker, D. T. Jones and W. A. Zisman, Ind. Eng. Chem. 41, 137 (1949). The test plates used in the test are equilateral triangles of steel (RRST 1403 m) with a side length of 45 mm and with the corners bent down obliquely which had in the center of the triangular surface a circular depression of 19 mm. diameter. These plates were coated with a 1% solution of the test substances in ligroin. Into the depression of the test plates were put 3 drops of a 3% common salt solution. The results were evaluated by visual determination of the amount of rust formed, compared to that of a blank value. The results of the test are compiled in Table 3.

Table 3

| Agent | Corrosion Test in Ligroin Solution Amount of Rust (% of Blank) After 1 Day | After 2 Days |
|---|---|---|
| Blank | 100% | 100% |
| A | 0–5 | 0–5 |
| B | 10 | 10 |
| C | 0 | 0 |
| D | 0–5 | 0–5 |
| E | 0 | 0 |
| F | 5 | 5 |
| G | 40–50 | 40–50 |
| H | 40 | 40 |
| I | 30 | 30 |

The aminoalkanol mixtures and their salts show a good corrosion inhibiting effect in the water drop test. Best results were obtained when the aminoalkanols were present in the form of their salts with an organic acid and when the sum of the carbon atom in the $R_1$ and $R_2$ substituents of the aminoalkanols mixtures was 9 to 12.

EXAMPLE 2

The corrosion inhibiting properties of the aminoalkanols in acid medium were determined by means of the column test [see E. G. Nottes, Erdoel und Kohle 15, 640 (1962)]. In this test a cleaned test strip of steel (RST 1404, measuring 150 × 10 × 1 mm.) in a distillation column is contacted for 1.5 hours with the distillation vapor of a mixture of hydrocarbons (300 ml. of toluene, 300 ml. of xylene, and 400 ml. of ligroin) and dilute hydrochloric acid (70 ml. of 2 N hydrochloric acid) and at the same time the strip is wetted continuously with a 1% solution of the aminoalkanol mixture in ligroin (about 0.5 drop/sec.). The corrosion inhibitors were applied in free base form, and were converted to salt form on the surface of the steel. The weight lost by the strip in the test is then determined. In a blank test, a test strip is wetted with drops of ligroin during the distillation. Results are shown in Table 4.

Table 4

| Agent | Column Test Weight Lost (mg.) |
|---|---|
| Blank | 95 |
| A | 25 |
| B | 23 |
| G | 42 |
| H | 42 |
| I | 30 |

EXAMPLE 3

Skin Tolerance Test

The effect of the aminoalkanol mixtures of the invention to skin was determined by the use of hairless mice. To this end the aminoalkanols were prepared as 1% and 2.5% solutions in olive oil, and about 100 mg. of each preparation was applied to the back skin of the mice once a day for about 1 week. A group of five test animals was used for each agent tested.

The reaction of the skin regarding reddening, swelling, pigmentation, scaling and necroses was rated daily. The results of the tests are compiled in Table 5.

Table 5

| Agent | Skin Tolerance Conc. | Reaction |
|---|---|---|
| A | 2.5% | No reaction |
| B | 2.5% | Reddening and slight scaling after 4 days |
| G | 2.5% | Necrotic changes |
| J | 1.0% | Pronounced reddening after 4 days; reddening and eczemas after 5 days |

EXAMPLE 4

The local tolerance of membranes for the aminoalkanol mixtures was determined by dropping small amounts of 2.5% solutions of the test substances in olive oil once into the conjuctival sac of one eye of groups of albino rabbits. The reactions of the mucous membranes of the eye were evaluated according to a point system by Draize [Appraisal of the safety of chemical in foods, drugs and cosmetics., Assn. of Food and Drug Officials of the U.S., pp. 49–52 (1959) ] at the end of the following lengths of time after application: 2 hours; and 1,2,4,6 and 8 days. The results of the test are shown in Table 6.

Table 6

| Agent | Mucous Membrane Tolerance Conc. | Reaction |
|---|---|---|
| A | 2.5% | Moderate conjuctival reaction disappeared almost completely after 24 hours, and completely disappeared after 2 days. |
| B | 2.5% | Moderate conjuctival reaction, and completely disappeared after 2 days. |
| G | 2.5% | Moderate conjunctival reaction; completely disappeared after 4 days. |
| J | 1.0% | Strong conjuctival reaction; after 8 days still 30–40% of the maximum reaction remained. |

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A shaped article having a surface of a corrodible iron-containing metal, said surface carrying a corrosion-inhibiting coating of a material selected from the group consisting of (A) mixtures of at least two amino-alkanols of the formula:

$$R_1-\underset{\underset{OH}{|}}{CH}-\underset{\underset{NH_2}{|}}{CH}-R_2$$

wherein $R_1$ and $R_2$ each represent $C_{1-21}$ alkyl; and wherein the sum of the carbon atoms in $R_1$ and $R_2$ is between 6 and 22; and (B) salts thereof, the vicinal $$\underset{OH}{|} \text{ and } \underset{NH_2}{|}$$

substituents being statistically distributed along the $$R_1-\underset{|}{CH}-\underset{|}{CH}-R_2$$

chain in accordance with known frequency of distribution curves.

2. An article according to claim 1 wherein the surface is steel.

3. An article according to claim 1 wherein the mixture of aminoalkanols is present as a salt.

4. An article according to claim 3 wherein the mixture of aminoalkanols is present as a salt with an organic acid.

5. An article according to claim 1 wherein the sum of the carbon atoms in the $R_1$ and $R_2$ substituents is 9 to 12.

6. An article according to claim 1 wherein the coating is of substantially monomolecular thickness.

7. A process for inhibiting the tendency of a shaped article having a surface of a corrodible iron-containing metal to corrode when in contact with an aqueous medium, which comprises uniformly coating said surface with a corrosion-inhibiting material selected from the group consisting of (A) mixtures of at least two aminoalkanols of the formula:

$$R_1-\underset{\underset{OH}{|}}{CH}-\underset{\underset{NH_2}{|}}{CH}-R_2$$

wherein $R_1$ and $R_2$ each represent $C_{1-21}$ alkyl; and wherein the sum of the carbon atoms in $R_1$ and $R_2$ is between 6 and 22; and (B) salts thereof, the vicinal $$\underset{OH}{|} \text{ and } \underset{NH_2}{|}$$

substituents being distributed uniformly along the $$R_1-\underset{|}{CH}-\underset{|}{CH}-R_2$$

chain.

8. A process according to claim 7 wherein said corrosion-inhibiting material is coated on said surface in solution in an anhydrous organic solvent.

9. A process according to claim 8 wherein said corrosion-inhibiting material is coated on said surface as a free base in solution in an anhydrous organic solvent, and said surface is contacted with an acid whereby said free base is converted to salt form.

* * * * *